US012660928B2

(12) United States Patent
Trznadel

(10) Patent No.: US 12,660,928 B2
(45) Date of Patent: Jun. 23, 2026

(54) TREE HUNTING LOWER BACK SUPPORT ASSEMBLY AND METHOD THEREFOR

(71) Applicant: Justin Trznadel, North Irwin, PA (US)

(72) Inventor: Justin Trznadel, North Irwin, PA (US)

( * ) Notice: Subject to any disclaimer, the term of this patent is extended or adjusted under 35 U.S.C. 154(b) by 152 days.

(21) Appl. No.: 18/794,866

(22) Filed: Aug. 5, 2024

(65) Prior Publication Data

US 2026/0033638 A1 Feb. 5, 2026

(51) Int. Cl.
*A47C 7/42* (2006.01)

(52) U.S. Cl.
CPC ..... *A47C 7/42* (2013.01)

(58) Field of Classification Search
CPC .... A47C 7/36; A47C 7/38; A47C 7/40; A47C 7/402; A47C 7/405; A47C 7/407; A47C 7/42; A47C 7/425; A47C 7/44; A47C 7/441; A45F 3/24; A45F 3/26; A01M 31/02; A63B 27/02; E04H 15/001; Y10S 135/901
See application file for complete search history.

(56) References Cited

U.S. PATENT DOCUMENTS 3,078,951 A * 2/1963 Schneebeli ..... A63B 27/02 182/221
3,856,349 A * 12/1974 Light ..... A47C 7/40 297/230.12
3,960,240 A 6/1976 Cotton
4,025,105 A * 5/1977 Pekala ..... A47C 7/021 297/4
4,230,203 A 10/1980 Sweat
4,417,645 A 11/1983 Untz
5,167,298 A * 12/1992 Porter ..... A01M 31/02 182/135
5,641,036 A 6/1997 Maxwell
6,652,027 B1 * 11/2003 Pardonnet ..... A47C 7/425 297/230.12
8,297,706 B2 * 10/2012 Matthews ..... A47C 16/005 297/423.11
9,924,779 B1 * 3/2018 Parsons ..... A45F 3/005
2012/0174318 A1 * 7/2012 Vestergaard ..... A47C 7/402 248/397
2016/0176082 A1 * 6/2016 Bigolin ..... B29C 43/04 297/391
2017/0027159 A1 * 2/2017 Johnson ..... A01M 31/02
2019/0335905 A1 * 11/2019 Alexander ..... A61H 15/00
2021/0076666 A1 * 3/2021 Power, II ..... F16B 2/08
2024/0188718 A1 * 6/2024 Boatright ..... A47C 7/42

FOREIGN PATENT DOCUMENTS

CN 202949913 5/2013

* cited by examiner

*Primary Examiner* — George Sun

(57) ABSTRACT

A tree hunting lower back support assembly includes a plurality of back support members and a belt. Each of the back support members includes a hard material and a curved section to be placed against the lower back of a person. Each of the back support members has a different thickness to permit selective positioning of one of the back support members between a tree and the lower back of a hunter in a tree stand. The belt is sufficiently long to be wrapped around and secured to a tree trunk to hold the back support members against a tree.

19 Claims, 9 Drawing Sheets

TREE HUNTING LOWER BACK SUPPORT ASSEMBLY AND METHOD THEREFOR

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to tree hunting accessories and more particularly pertains to a new tree hunting lower back support assembly for providing lower back support and comfort for hunters standing or sitting in a tree stand. As is well known in the filed of hunting, tree stands are used to allow a hunter to station himself in a tree a substantial distance from the ground in order to assist the hunter in avoiding detection by game animals and to provide a better vantage point and angle for tracking and killing game animals. Many tree stands are relatively small and require the hunter to stand, sometimes for hours, as the hunter waits for approaching game animals. Standing for such long periods, as is well known, can be quite uncomfortable, especially for persons with leg or back issues or injuries. While the tree itself can provide some comfort as the hunter leans against the tree, the relatively flat surface does not provide the type of support that would be most helpful to many hunters. The tree hunting lower back support assembly of the present application provides targeted and adjustable support for the lower back of a hunter when leaning against a tree via a lightweight, compact, and portable device that can be easily carried in a hunting pack or gear, whether walking or climbing a tree. In addition, the tree hunting lower back support assembly provides a very firm or hard support so the hunter can experience a strong support and a massaging effect through his normally relatively thick or heavy gear.

(2) Description of Related Art Including Information Disclosed Under 37 CFR 1.97 and 1.98

The prior art relates to tree hunting accessories. The prior art, as best understood, does not disclose a tree hunting lower back support assembly of the present application provides targeted and adjustable support for the lower back of a hunter when leaning against a tree via a lightweight, compact, and portable device that can be easily carried in a hunting pack or gear, whether walking or climbing a tree. Some hunting devices and accessories can provide back support, but are in the form of complex and large seats and devices that are not easily transported, especially when climbing a tree, or usable with all types of tree stands. Further, the prior art does not provide a very firm or hard support that is also adjustable.

BRIEF SUMMARY OF THE INVENTION

An embodiment of the disclosure meets the needs presented above in a tree hunting lower back support assembly generally comprising a plurality of back support members and a belt. Each of the back support members includes a hard material and a curved section to be placed against the lower back of a person. Each of the back support members has a different thickness to permit selective positioning of one of the back support members between a tree and the lower back of a hunter in a tree stand. The belt is sufficiently long to be wrapped around and secured to a tree trunk to hold the back support members against a tree.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
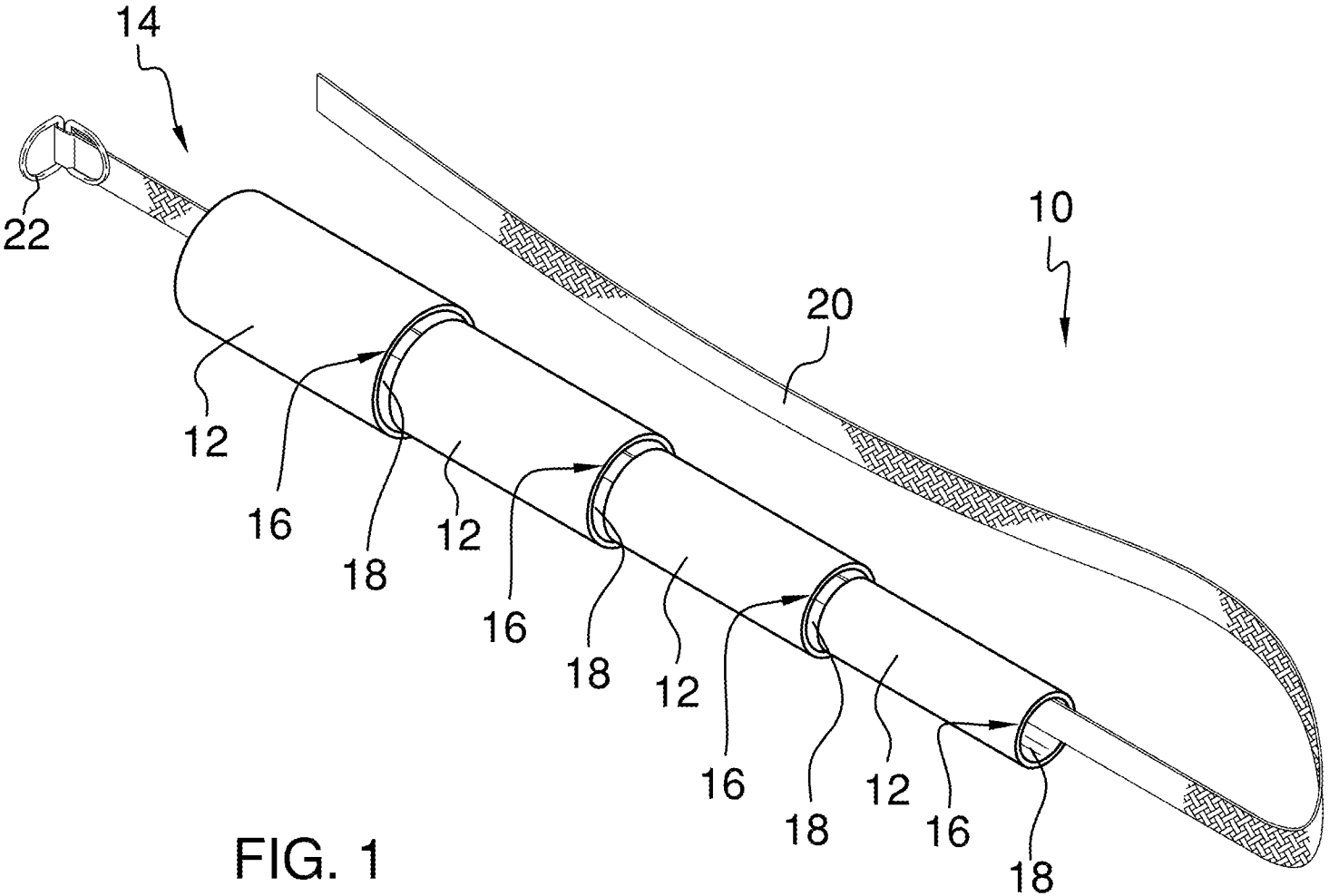
FIG. 1 is a perspective view of a tree hunting lower back support assembly according to an embodiment of the disclosure.

With reference now to the drawings, and in particular to FIGS. 1 through 12 thereof, a new tree hunting lower back support assembly embodying the principles and concepts of an embodiment of the disclosure and generally designated by the reference numeral 10 will be described.

As best illustrated in FIGS. 1 through 5, the tree hunting lower back support assembly 10 generally comprises a plurality of back support members 12 and a belt 14. Each of the back support members 12 includes a hard material and a curved section 16 to be placed against the lower back of a person. Each of the back support members 12 has a different thickness to permit selective positioning of one of the back support members 12 between a tree 70 and a lower back of a hunter 74 in a tree stand 76. The belt 14 is sufficiently long to be wrapped around and secured to a tree trunk 72 to hold the back support members 12 against the tree 70.

As shown in FIGS. 1 through 5, each of the back support members 12 includes a passage 18 therein designed to permit the back support members 12 of a smaller thickness to be removably inserted into the back support members 12 of a larger thickness in a telescoping manner. This design allows the hunter 74 to select which back support member 12 he wishes to use depending on the shape of his lower back and the type of support desired. In the exemplary embodiment shown in FIGS. 1 and 2, there are four back support members 12, though fewer or greater numbers of back support members 12 could be used, that are cylindrical such that the curved section 16 extends about the entirety of the outer surface. In other words, no matter how the back support members 12 are oriented the curved section 16 faces away from the tree 70. Each of the back support members 12 is shown removed in FIG. 1, whereas they are all in a compact state 32 in FIG. 2. In use, the hunter 74 could separate all of the back support members 12 as shown in FIG. 1 and as in FIG. 5, or only remove one of the back support members 12 and leave the rest in the compact state 32 shown in FIG. 2.

The back support members 12 are made of a hard material, as mentioned above, which hard material could be a rigid plastic, rubber, elastomer, or a combination thereof. For example, the back support members 12 could be made of polycarbonate, polyvinyl chloride (PVC), or similar hard or rigid plastics. The back support members 12 could also be made of thick or hard rubber or elastomers. Combinations of different materials are also possible, such as a core of one type of material and an outer surface or portion of a different material, such as a PVC core and a hard rubber coating.

Figure 2:
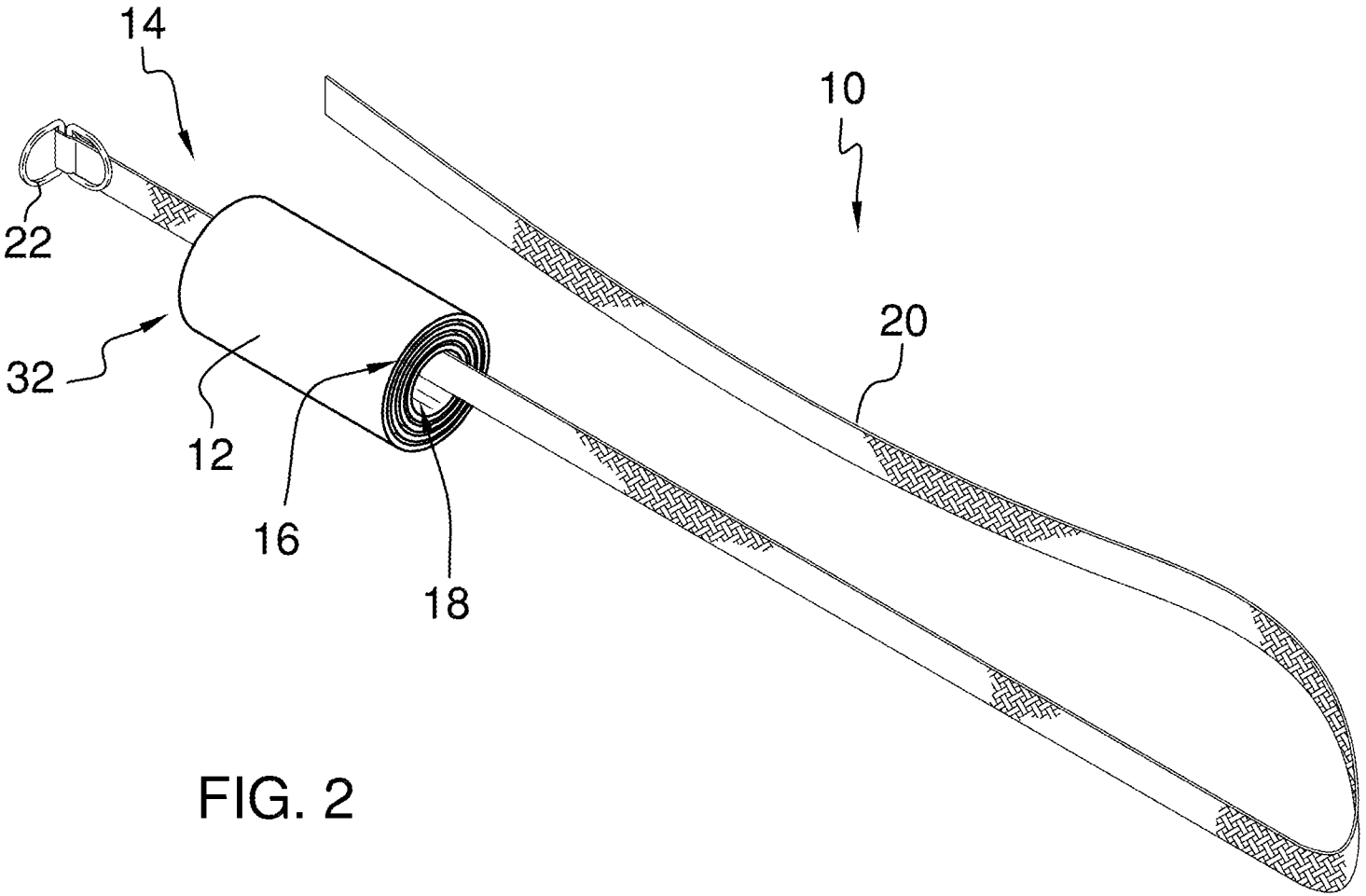
FIG. 2 is a perspective view of an embodiment of the disclosure.

The belt 14 includes a strap 20 and a buckle 22 designed to connect free ends of the strap 20 together to form a closed loop. In the exemplary embodiment shown, the strap 20 is a durable and flexible material, such as a textile or similar made of synthetic or natural fibers, such as nylon. A rope or similar structure could also be used. The buckle 22 shown in the exemplary embodiment is a double-ring buckle, though essentially any type of buckle or connector could be utilized, such as snaps, buttons, or similar. As shown in FIGS. 1 and 2, the strap 20 is positioned to pass through the passages 18 such that the back support members 12 are slidable along and rotatable about the strap 20. The design and positioning of the back support members 12 on the strap 20 allows the user to move the back support members 12 along the strap 20 to adjust the position thereof, even when the strap 20 is attached to the tree 70. In addition, the cylindrical back support members 12 allow some rotation or pivoting as the user leans against the back support members 12, which can provide a massaging type of effect. In another possible embodiment, each of the back support members 12 could be attached to individual places on the strap 20, such that the back support members 12 are not slidable along the strap 20. In this embodiment, the belt 14 would have to be rotated around the trunk 72 to place the back support members 12 in a desired position.

Figure 6:
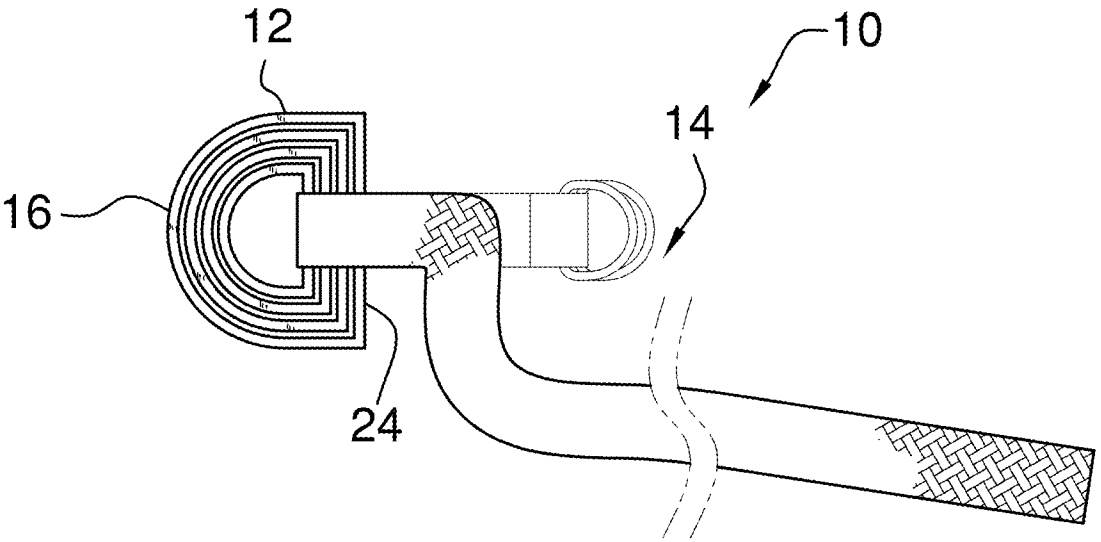
FIG. 6 is a side view of a first alternative embodiment of the disclosure.

FIGS. 6 through 12 show alternative designs and embodiments of the tree hunting lower back support assembly 10, the components and features of which can be utilized or incorporated for use or combined with any one or more of the other embodiments disclosed herein. FIG. 6 shows a first alternative embodiment, in which each of the back support members 12 includes a flat section 24 integrally formed with the curved section 16, wherein the flat section 24 is designed to be placed against the tree 70. The back support members 12 therefore have an essentially D-shaped cross-sectional profile, and the flat section 24 provides a flat surface for the strap 20 to rest against.

Figure 3:
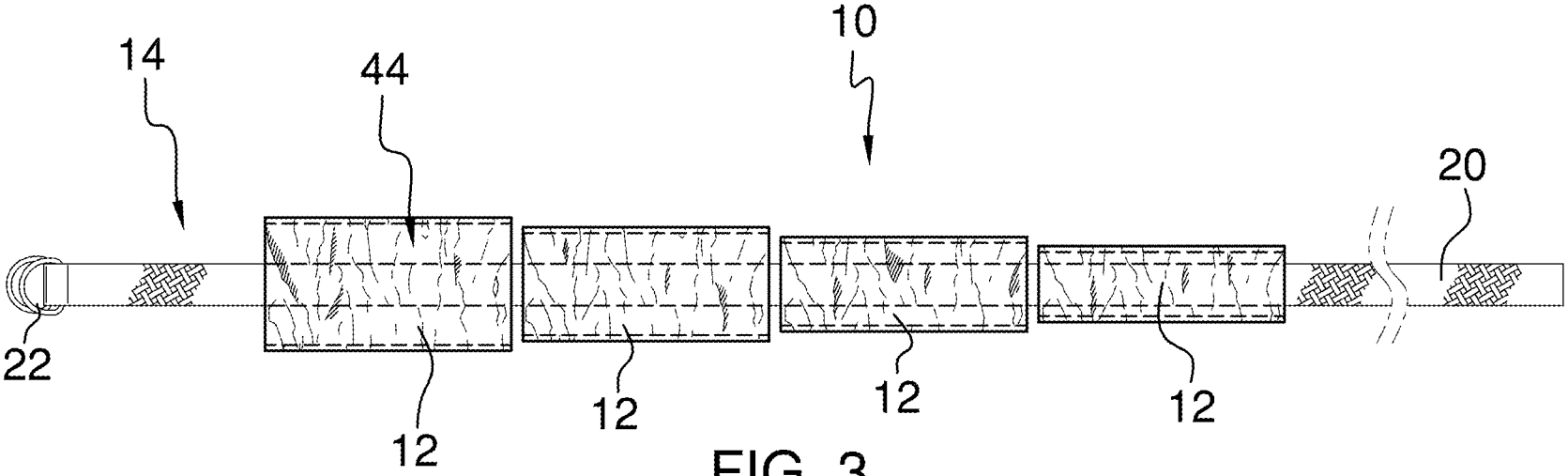
FIG. 3 is a front view of an embodiment of the disclosure.
Figure 4:
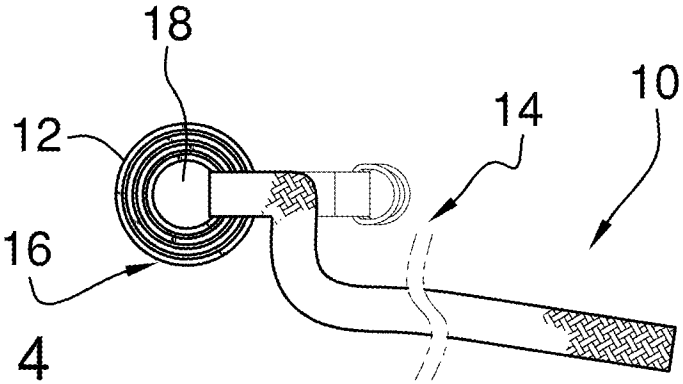
FIG. 4 is a side view of an embodiment of the disclosure.
Figure 7:
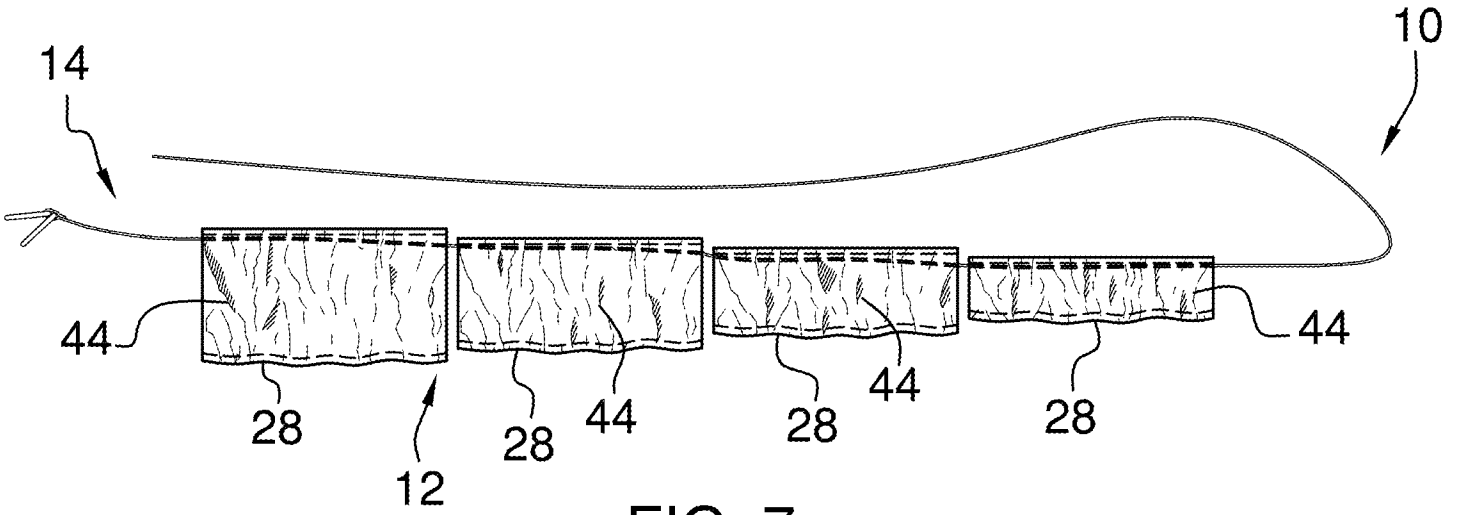
FIG. 7 is a top view of a second alternative embodiment of the disclosure.
Figure 11:
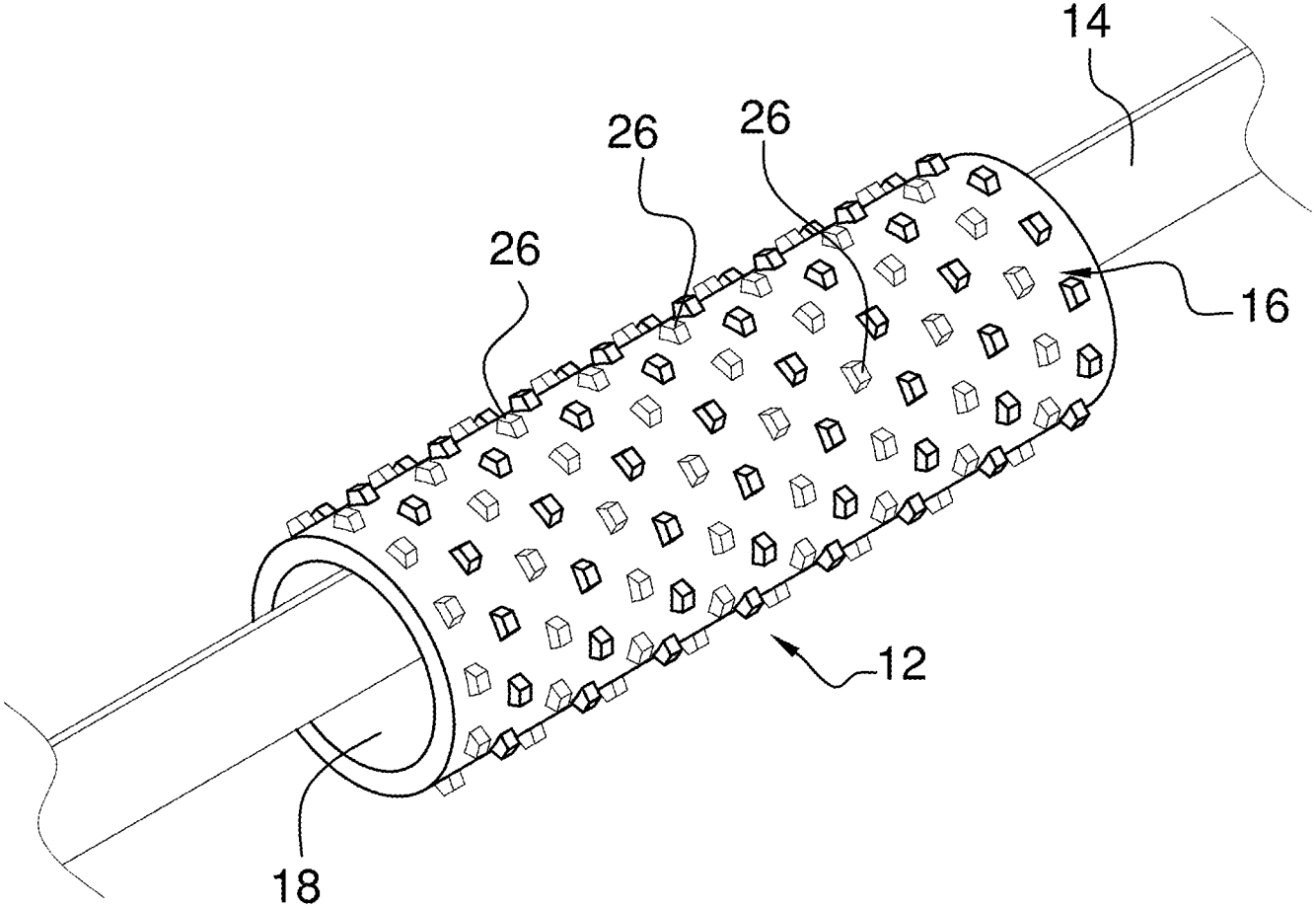
FIG. 11 is a perspective view of a fifth alternative embodiment of the disclosure.
Figure 12:
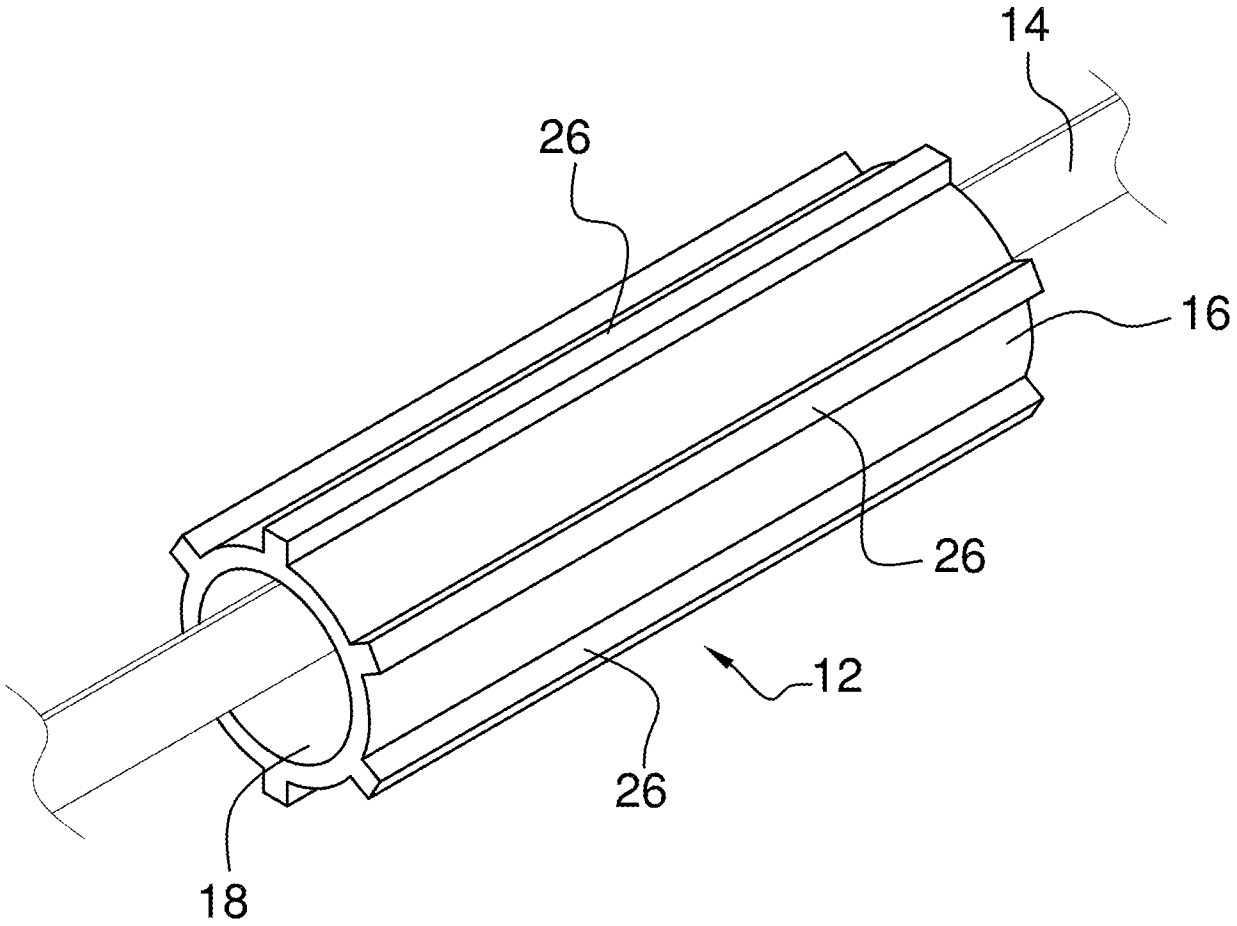
FIG. 12 is a perspective view of a sixth alternative embodiment of the disclosure.

FIGS. 7, 11, and 12 show second, fifth, and sixth alternative embodiments, respectively, in which the back support members 12 could include a plurality of projections 26 on the curved section 16. The projections 26 can provide a massaging effect or stimulating effect. In FIG. 7, each of the back support members 12 includes a contoured outer surface 28 that has grooves and ridges designed to imitate tree bark. The contoured outer surface 28 can additionally be painted or colored to further imitate tree bark for camouflage and aesthetic purposes, which could be done for any of the designs or components herein, as shown in FIG. 3 where the outer surface, which is smooth, is marked with a tree bark design 44. In FIG. 11, the projections 26 are polygonal bumps, which could be cubes, domes, pyramids, or any other polygonal shape, or a combination thereof. In FIG. 12, the projections 26 are straight ridges, but could be curved ridges. In another possible embodiment, any of the projections 26 can be combined to form any design. In one possible embodiment, the interior surface of each of the back support members 12 could have matching recesses such that the back support members 12 can fit together in a meshed, telescoping manner, like splines or gears.

Figure 10:
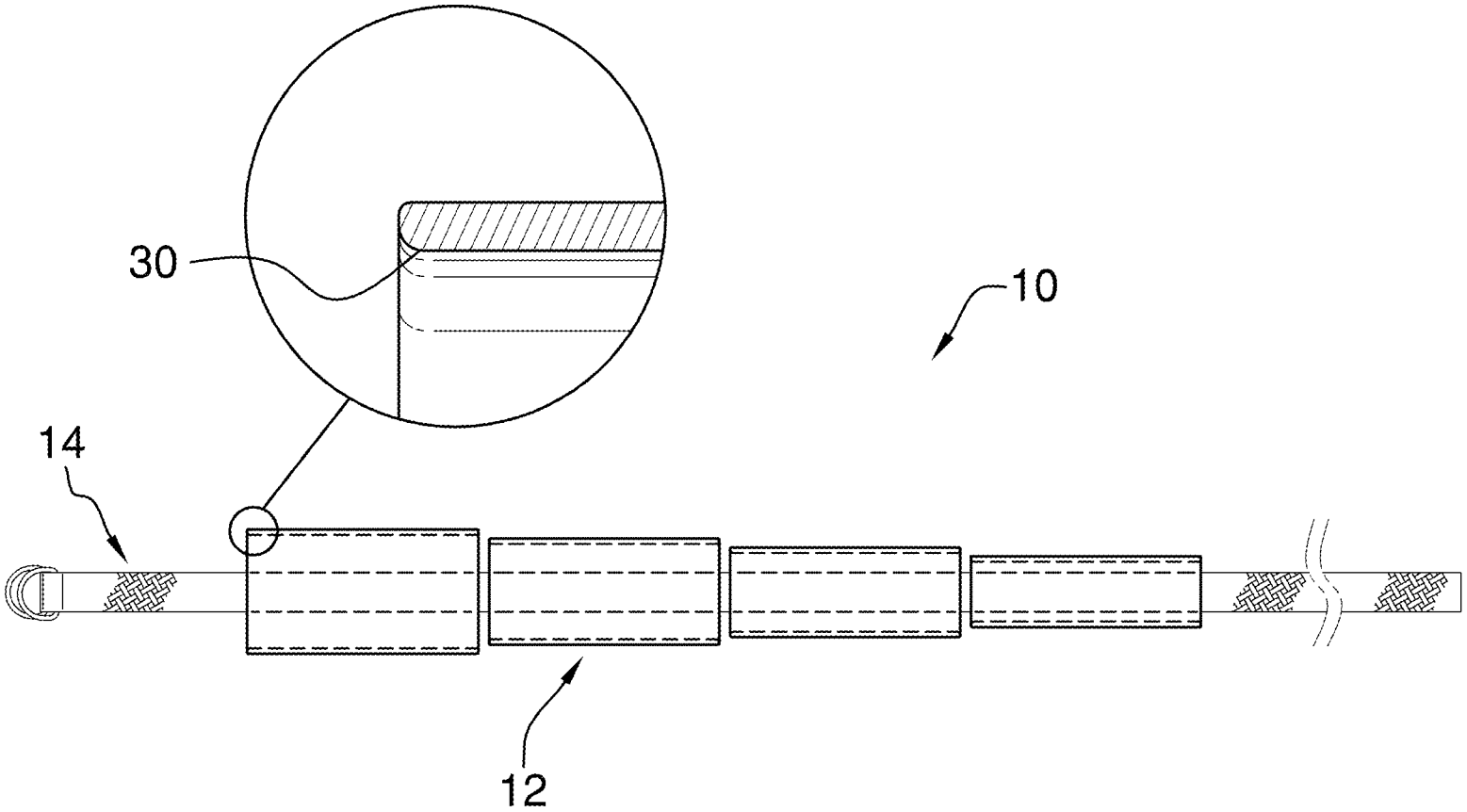
FIG. 10 is a top view of a fourth alternative embodiment of the disclosure.

FIG. 10 shows a fourth alternative embodiment, wherein each of the back support members 12 includes tapered edges 30 at opposite ends of the passage 18. The tapered edges 30 could assist in placement of the strap 20 and to protect the strap 20 against unwanted wear and tear.

Figure 5:
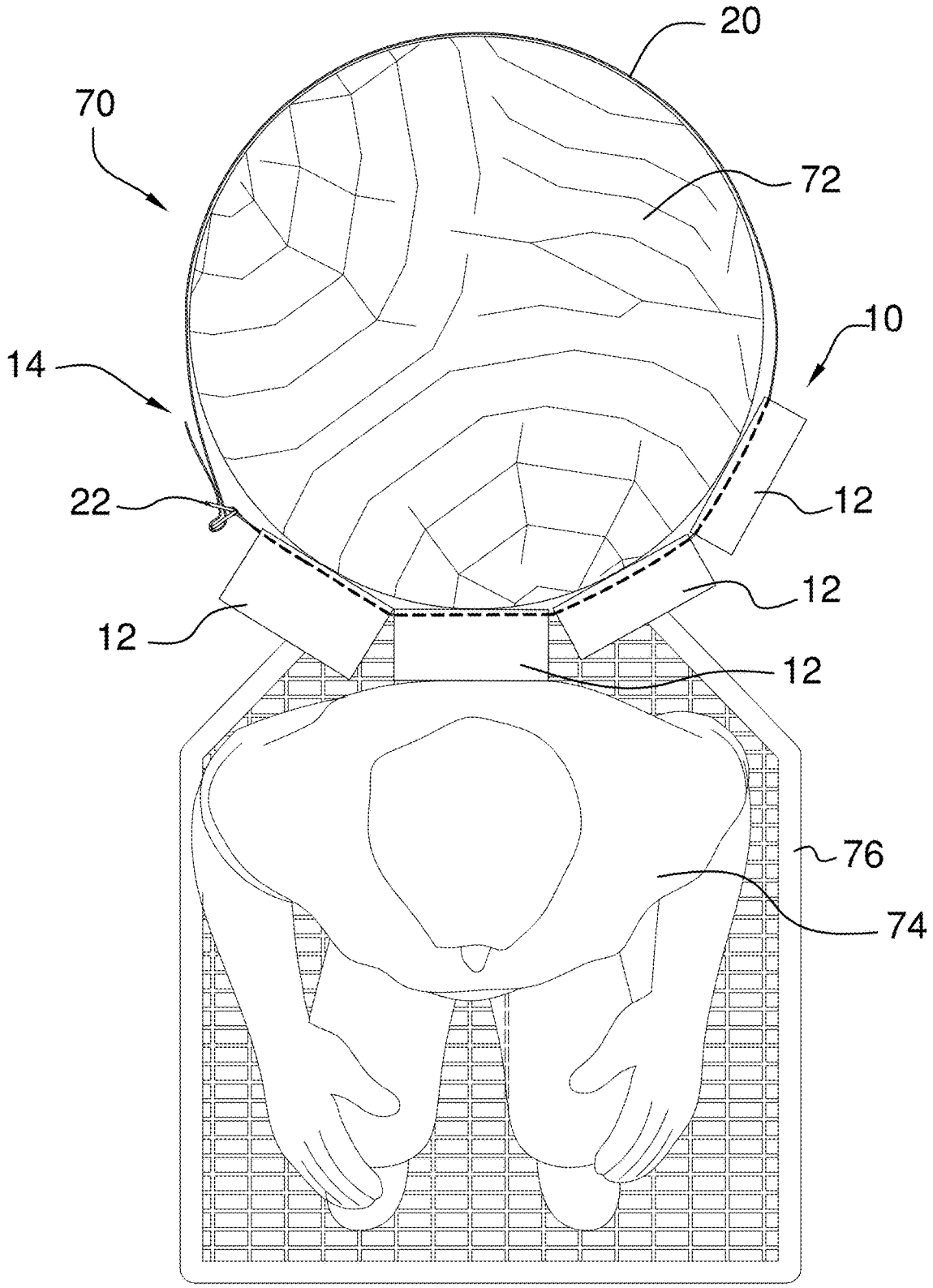
FIG. 5 is a top view of an embodiment of the disclosure in use.

In order to use the tree hunting lower back support assembly 10, as shown in FIG. 5, the hunter 74 places the belt 14 about the trunk 72 of the tree 70. The hunter 74 could place the belt 14 loosely about the trunk 72 while the user is on the ground and then slide the belt 14 up the trunk 72 as the hunter 74 climbs. Alternatively, the hunter 74 could carry the tree hunting lower back support assembly 10 in the compact state 32 in a stowed position while climbing, and then place the belt 14 when the hunter 74 is in the tree stand 76. Regardless, the hunter 74 then secures the back support members 12 against the tree 70 with the belt 14 at a desired position adjacent a lower back of the hunter 74 in the tree stand 76. The hunter 74 selectively positions one of the back support members 12 between the tree 70 and the lower back of the hunter 74 in the tree stand 76. As shown in FIG. 5, the hunter 74 is using one of the back support members 12, while the other back support members 12 are positioned to the sides. However, it is not necessary for the hunter 74 to separate each of the back support members 12, but rather the hunter 74 can remove one of the back support members 12 from the compact state 32 shown in FIG. 2. For example, if the hunter 74 wished to use the largest or thickest of the back support members 12, the other back support members 12 could be left together in the compact state 32. If, upon use of the selected one of the back support members 12, the hunter 74 wishes to utilize another one of the back support members 12, the hunter 74 can simply slide another one of the back support members 12 into the desired position between the tree 70 and the lower back of the hunter 74.

Figure 8:
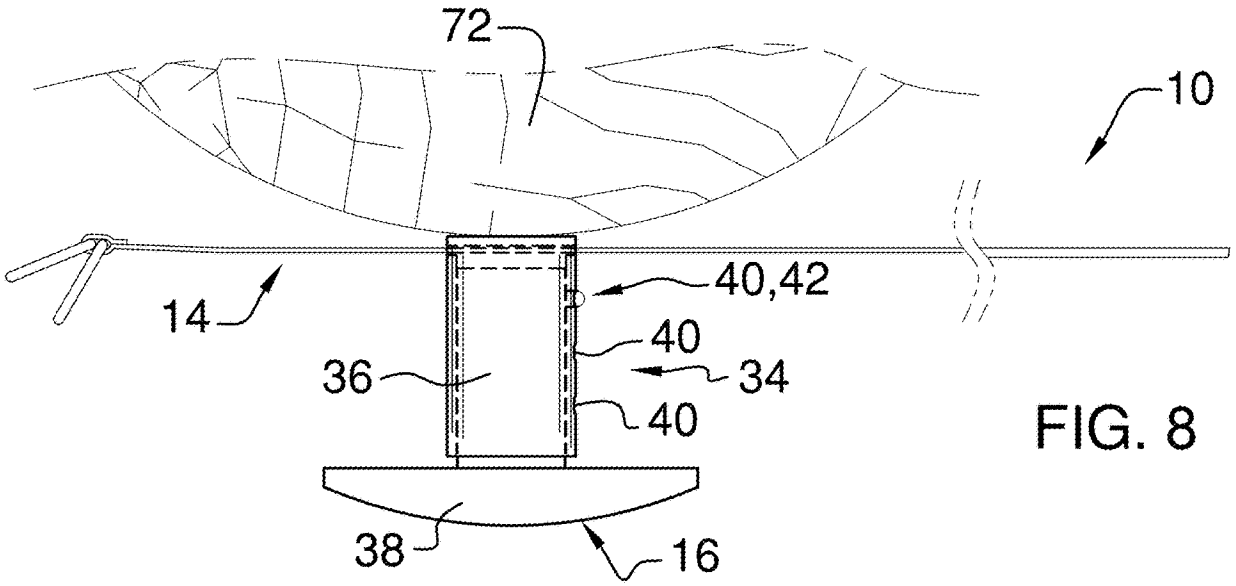
FIG. 8 is a top view of a third alternative embodiment of the disclosure.
Figure 9:
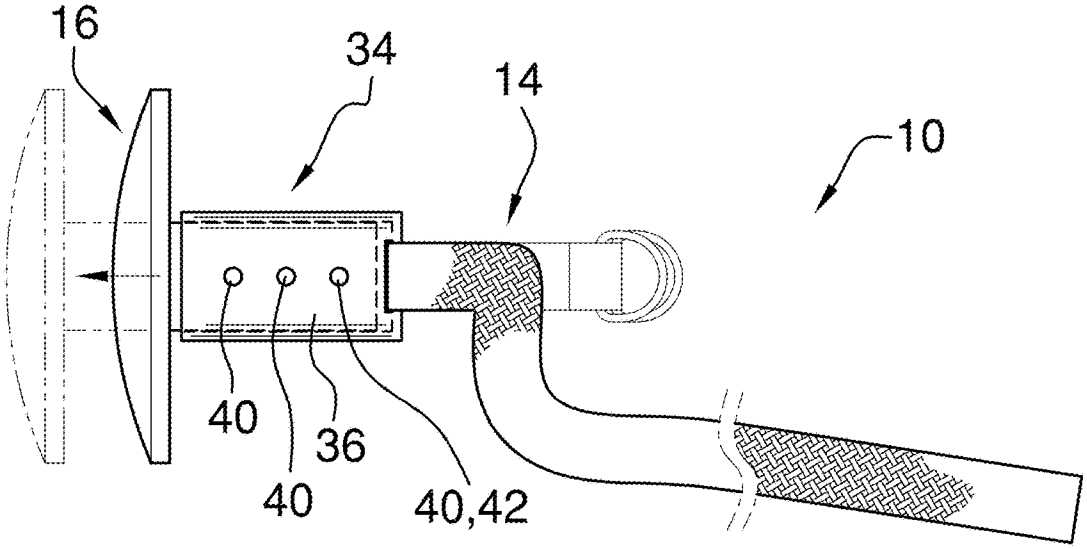
FIG. 9 is a side view of the third alternative embodiment of the disclosure.

FIGS. 8 and 9 show a third alternative embodiment of the disclosure, which is a design of the tree hunting lower back support assembly 10 that deviates from the telescoping design on FIGS. 1 through 7 and 10 through 12, though this design could incorporate features from the telescoping design and vice versa. In this embodiment, a back support device 34 includes a mounting portion 36 designed to be placed against the trunk 72 of the tree 70 and a back support portion 38 attached to the mounting portion 36. The back support portion 38 includes a hard material and a curved section 16 to be placed against the lower back of the hunter 74. The mounting portion 36 is adjustable in length to permit selective adjustment of the overall thickness of the back support device 34. The belt 14 is also used in this embodiment to hold the mounting portion 36 against the tree 70. While different in design, the effect of the back support device 34 is the same as that of the back support members 12, that is, to provide lower back support that can be adjusted in thickness, which is achieved using the single mounting portion 36 as opposed to the back support members 12 of different thicknesses. In the exemplary embodiment shown, the mounting portion 36 has a telescoping design with openings 40 and a spring-loaded push button 42 for fixed adjustments, though other adjustment mechanisms, such as tabs, set screws, threaded portions, or friction fits could be utilized.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A tree hunting lower back support assembly comprising:

a plurality of back support members each comprising a hard material and a curved section to be placed against the lower back of a person, wherein each of said back support members has a different thickness to permit selective positioning of one of said back support members between a tree and the lower back of a hunter in a tree stand; and a belt sufficiently long to be wrapped around and secured to a tree trunk to hold said back support members against a tree;

wherein each of said back support members comprises a passage therein configured to permit said back support members of a smaller thickness to be removably inserted into said back support members of a larger thickness in a telescoping manner.

2. The tree hunting lower back support assembly of claim 1, wherein said back support members are cylindrical such that said curved section extends about the entirety of the outer surface.

3. The tree hunting lower back support assembly of claim 1, wherein each of said back support members comprises a flat section integrally formed with said curved section, wherein said flat section is configured to be placed against a tree.

4. The tree hunting lower back support assembly of claim 1, wherein said hard material comprises rigid plastic, rubber, elastomer, or a combination thereof.

5. The tree hunting lower back support assembly of claim 1, wherein each of said back support members comprises tapered edges at opposite ends of said passage.

6. The tree hunting lower back support assembly of claim 1, wherein each of said back support members comprises a plurality of projections on said curved section.

7. The tree hunting lower back support assembly of claim 6, wherein said projections comprise polygonal bumps, straight ridges, curved ridges, or a combination thereof.

8. The tree hunting lower back support assembly of claim 1, wherein each of said back support members comprises a contoured outer surface comprising grooves and ridges configured to imitate tree bark.

9. The tree hunting lower back support assembly of claim 1, wherein said belt comprises a strap and a buckle configured to connect free ends of said strap together to form a closed loop.

10. The tree hunting lower back support assembly of claim 1, wherein said belt comprises a strap and a buckle configured to connect free ends of said strap together to form a closed loop, and said strap is disposed to pass through said passages such that said back support members are slidable along and rotatable about said strap.

11. A method of using the tree hunting lower back support assembly of claim 1 comprising the steps of:

placing said belt about a trunk of a tree;

securing said back support members against the tree with said belt at a desired position adjacent a lower back of a hunter in a tree stand; and selectively positioning one of said back support members between the tree and the lower back of the hunter in the tree stand.

12. The method of claim 11, wherein each of said back support members comprises a passage therein configured to permit said back support members of a smaller thickness to be removably inserted into said back support members of a larger thickness in a telescoping manner, and wherein the method further comprises:

transporting the tree hunting lower back support assembly to the tree in a compact state in which each of said back support members of a smaller thickness are removably inserted into said back support members of a larger thickness in a telescoping manner; and said step of selectively positioning comprises moving a selected one of said back support members out from the others of said back support members in said compact state.

13. The method of claim 11, wherein said method further comprises selecting and positioning another one of said back support members between the tree and the lower back of the hunter in the tree stand.

14. A tree hunting lower back support assembly comprising:

a plurality of back support members each comprising a hard material and a curved section to be placed against the lower back of a person, wherein each of said back support members has a different thickness to permit selective positioning of one of said back support members between a tree and the lower back of a hunter in a tree stand, wherein:

each of said back support members comprises a passage therein configured to permit said back support members of a smaller thickness to be removably inserted into said back support members of a larger thickness in a telescoping manner, said back support members are cylindrical such that said curved section extends about the entirety of the outer surface, said hard material comprises rigid plastic, rubber, elastomer, or a combination thereof; and a belt sufficiently long to be wrapped around and secured to a tree trunk to hold said back support members against a tree, wherein:

said belt comprises a strap and a buckle configured to connect free ends of said strap together to form a closed loop, said strap is disposed to pass through said passages such that said back support members are slidable along and rotatable about said strap.

15. The tree hunting lower back support assembly of claim 14, wherein said hard material comprises rigid plastic, rubber, elastomer, or a combination thereof.

16. The tree hunting lower back support assembly of claim 14, wherein each of said back support members comprises tapered edges at opposite ends of said passage.

17. The tree hunting lower back support assembly of claim 14, wherein each of said back support members comprises a plurality of projections on said curved section, wherein said projections comprise polygonal bumps, straight ridges, curved ridges, or a combination thereof.

18. The tree hunting lower back support assembly of claim 14, wherein each of said back support members comprises a contoured outer surface comprising grooves and ridges configured to imitate tree bark.

19. A tree hunting lower back support assembly comprising:

a back support device comprising a mounting portion configured to be placed against a trunk of a tree and a back support portion attached to said mounting portion, wherein said back support portion comprises a hard material and a curved section to be placed against the lower back of a hunter in a tree stand, and wherein said mounting portion is adjustable in length to permit selective adjustment of the overall thickness of the back support device; and a belt sufficiently long to be wrapped around and secured to a tree trunk to hold said mounting portion against a tree;

wherein said back support members are cylindrical such that said curved section extends about the entirety of the outer surface.

* * * * *